US005134815A

United States Patent [19]

Pickett

[11] Patent Number: 5,134,815

[45] Date of Patent: Aug. 4, 1992

[54] BARRIER STRUCTURE

[76] Inventor: William H. Pickett, 4028 N. Ocean Dr., Hollywood, Fla. 33019

[21] Appl. No.: 638,683

[22] Filed: Jan. 8, 1981

Related U.S. Application Data

[63] Continuation-in-part of Ser. No. 335,546, Apr. 10, 1989, Pat. No. 4,982,535.

[51] Int. Cl.[5] ..... E04B 7/16

[52] U.S. Cl. ..... 52/71; 52/247; 52/595; 405/285

[58] Field of Search ..... 256/13.1, 19, 24, 25, 256/26; 52/71, 245, 248, 593, 595, 227, 246, 247, 64, 65, 70; 405/284, 285, 277, 286, 151, 152, 153; 404/41

[56] References Cited

U.S. PATENT DOCUMENTS

| | | | |
|---|---|---|---|
| 490,162 | 1/1893 | Ogletree . | |
| 1,012,423 | 12/1911 | Orr . | |
| 1,012,868 | 12/1911 | Laney . | |
| 1,144,468 | 6/1915 | Frost | 52/247 |
| 1,236,048 | 8/1917 | Buente . | |
| 1,361,831 | 12/1920 | Crew . | |
| 1,383,166 | 6/1921 | Steinkraus . | |
| 1,502,438 | 7/1924 | Price . | |
| 1,557,523 | 10/1925 | Hahn . | |
| 1,783,383 | 3/1930 | Montrief . | |
| 2,036,363 | 4/1936 | Schaefer . | |
| 2,141,397 | 12/1938 | Locke . | |
| 2,780,150 | 2/1957 | Yoeman . | |
| 2,897,668 | 8/1959 | Graham . | |
| 2,920,475 | 1/1960 | Graham . | |
| 2,950,576 | 8/1960 | Rubenstein . | |
| 3,126,671 | 3/1964 | Nagel . | |
| 3,369,334 | 2/1968 | Berg . | |
| 3,418,388 | 12/1969 | Smart . | |
| 3,501,800 | 3/1970 | O'Dea . | |
| 3,537,687 | 11/1970 | Adelman . | |
| 3,656,576 | 4/1972 | Gubela . | |
| 3,732,653 | 5/1973 | Pickett . | |
| 3,890,751 | 6/1975 | Caputo et al. . | |
| 3,918,877 | 11/1975 | Pickett . | |
| 3,936,035 | 2/1976 | Weimer et al. . | |
| 3,965,627 | 5/1976 | Fencl . | |
| 4,111,401 | 9/1978 | Pickett . | |
| 4,138,947 | 2/1979 | Pickett . | |
| 4,214,411 | 7/1980 | Pickett . | |
| 4,402,384 | 9/1983 | Smith et al. . | |
| 4,426,176 | 1/1984 | Terada | 405/286 |
| 4,529,174 | 7/1985 | Pickett . | |
| 4,558,850 | 12/1985 | Melfi . | |
| 4,605,090 | 8/1986 | Melfi . | |
| 4,674,593 | 6/1987 | McCarty . | |
| 4,688,362 | 8/1987 | Pedersen . | |
| 4,862,992 | 9/1989 | Melfi . | |

FOREIGN PATENT DOCUMENTS

| | | | |
|---|---|---|---|
| 683834 | 7/1966 | Belgium . | |
| 490712 | 2/1953 | Canada . | |
| 734330 | 10/1932 | France | 52/248 |
| 1302 | of 1880 | United Kingdom . | |
| 155 | of 1892 | United Kingdom | 405/286 |
| 106399 | of 1917 | United Kingdom . | |

OTHER PUBLICATIONS

Bob Drake; Plant Operator's Forum, Training for Safety Greater Productivity; Concrete Producer News; Apr., 1991.

*Primary Examiner*—David A. Scherbel
*Assistant Examiner*—Creighton Smith
*Attorney, Agent, or Firm*—Fish & Richardson

[57] ABSTRACT

A barrier structure includes at least one panel disposed to extend generally along a fence line, the panel having an engaging element for pivotal joining of the panel to a member of the structure (such as a post or another panel). The engaging element includes an arcuate surface that extends from a proximal region of the engaging element to a distal end thereof. The arcuate surface has a predetermined radius of curvature that exceeds the length of the engaging element between the proximal region and the distal end.

27 Claims, 10 Drawing Sheets

BARRIER STRUCTURE

This application is a continuation-in-part of my copending application Ser. No. 07/335,546, filed Apr. 10, 1989, now U.S. Pat. No. 4,982,535, entitled "Barrier Structure", which is incorporated herein by reference (hereinafter, the "Parent Application").

BACKGROUND OF THE INVENTION

The invention relates to concrete constructions of discrete modular panels and connectors assembled to form outdoor landscape and noise barriers and the like.

Outdoor constructions of this type may be utilized as a barrier against, e.g., intruding people, animals or reptiles, vehicles, fire, wind and wind blown substances, as well as radiated waves in the form of radioactivity, light, radio frequency, noise, and heat. Numerous objectives should be considered, and ultimately balanced, in selection of such a modular barrier, including the cost of erecting the barrier (this requires, among other factors, the expense of fabricating and joining standardized modules), and ease of construction. Other, equally important, factors are the flexibility of the design, particularly where the barrier is to be constructed over varying or difficult terrain or within a narrow right-of-way, and durability and low maintenance cost.

Prior barriers proposed to meet these objectives are described in my earlier patents, including U.S. Pat. No. 3,732,656 (issued Feb. 26, 1973), U.S. Pat. No. 4,111,401 (issued Jun. 19, 1978), U.S. Pat. No. 4,138,947 (issued Feb. 13, 1979) and U.S. Pat. No. 4,214,411 (issued Jul. 29, 1980), the disclosures of which ar incorporated herein by reference, and as embodied in constructions of The Fanwall Company and The Reinforced Earth Company.

SUMMARY OF THE INVENTION

This invention features a barrier structure including at least one panel that extends generally along a fence line and is pivotally joined to another member of the structure with an engaging element having a configuration that significantly improves the resistance of the joint to shearing forces applied by wind and the like.

In a general aspect, the engaging element has an arcuate surface that extends from a proximal region to a distal end of the engaging element, and the arcuate surface has a radius of curvature that exceeds the length of the engaging element between the proximal region and the distal end.

Preferred embodiments include one or more of the following features.

The engaging element includes an opposite pair of arcuate surfaces that form a tongue. Preferably, the arcuate surfaces are arranged in an arched configuration. The radius of curvature of each arcuate surface is greater than half of the width of the panel, and preferably equals the width of the panel.

The member to which the panel is pivotally joined includes a second engaging element configured to receive the engaging element of the panel. The second engaging element includes a groove the shape of which is complementary to that of the first engaging element. The member is a post that is part of or is secured to a second panel. Each panel of the barrier structure has a first end at which the first engaging element is disposed and a second end at which the post and second engaging element are disposed. A plurality of the panels are connected along the fence line by the engagement of the first engaging element of one panel with the second engaging element of another panel.

The post can include a plurality of second engaging elements for engagement with the first engaging elements of a corresponding plurality of panels. The second engaging elements are disposed along a common axis, obliquely to each other, or orthogonally to each other.

In one embodiment, particularly useful for situations in which the right of way for the barrier wall structure is small, each panel is anchored to an entrenched mounting element which prevents overturning and provides vertical support. The mounting element is made, for example, from reinforced concrete and serves as a foundation for at least a portion of the panel. Preferably, the portion of the panel supported on the foundation is a post disposed oppositely to the engaging element and which receives the engaging element of another panel.

The post is fixed to the mounting element by at least one rod that extends from the post into an opening in the mounting element and the post, with the remainder of the opening being filled with grout to provide secure anchoring. Preferably, the opening in the mounting element is lined with corrugated metal (with the corrugations running horizontally) to prevent the rod from being withdrawn after the grout hardens. The rod is threaded into an opening on the underside of the post.

In another embodiment, the barrier wall structure is free-standing (i.e., does not require the use of mounting elements to provide structural support), and some panels are acutely angled with respect to the line of extension of the wall to provide the necessary structural support and avoid overturning. This configuration is particularly useful in applications in which the right of way for the wall is relatively wide.

In the free-standing wall, adjacent panels are tied together with a tensile connector assembly. Preferably, the connector assembly includes a cable that extends from the tongue-shaped engaging element of one panel and is received through an opening in the post of an adjacent panel. The opening is disposed between the groove-shaped connector element of the post and an opposite side of the post so that the cable can be securely anchored to the post. The cable extends from a cavity in the distal end of the tongue. This allows the panel to be disposed over a range of angles with respect to the post without requiring the cable to be bent through an undue angle (thereby reducing stresses on the cable).

The invention provides modular panel and post assemblies for a barrier wall structure that are generic in their outward appearance, regardless of whether a mounting element is used to provide structural support (by anchoring the panel/post assembly to the ground) or whether the panel/post assembly is free standing (with structural support being provided by securing the panel/post assembly to another panel/post assembly with a tensile connector assembly). The result is significantly lowered cost and increased structural and aesthetic flexibility for the designer in selecting each panel/post assembly in accordance with the terrain and with the position of the panel/post assembly in the barrier wall structure.

For example, in areas with narrow right of ways, the panel/post assemblies can be arranged in a straight (or curved) line along the line of extension of the barrier wall structure, with the individual posts anchored to the ground using mounting elements. Where the terrain requires, or in areas in which a wide right of way exists, the mounting elements may be omitted and the barrier wall structure made free standing by arranging some panel/post assemblies at acute angles with respect to other panel/post assemblies (to provide an undulating wall) and tying adjacent panel/post assemblies together using the tensile connector assemblies to provide structural support. The pointed arch-shaped tongue and grooves allows adjacent panel/post assemblies to be oriented at large angles with significantly reduced risk of dislodgement due to wind forces. Where the right of way again becomes narrow, the barrier structure can be converted from the undulating wall to a straight (or curved) wall by resuming the use of mounting elements to anchor the posts.

Other features and advantages of the invention will become apparent from the following description, and from the claims.

DESCRIPTION OF PREFERRED EMBODIMENTS

We first briefly describe the drawings.

STRUCTURE AND OPERATION

Figure 1:
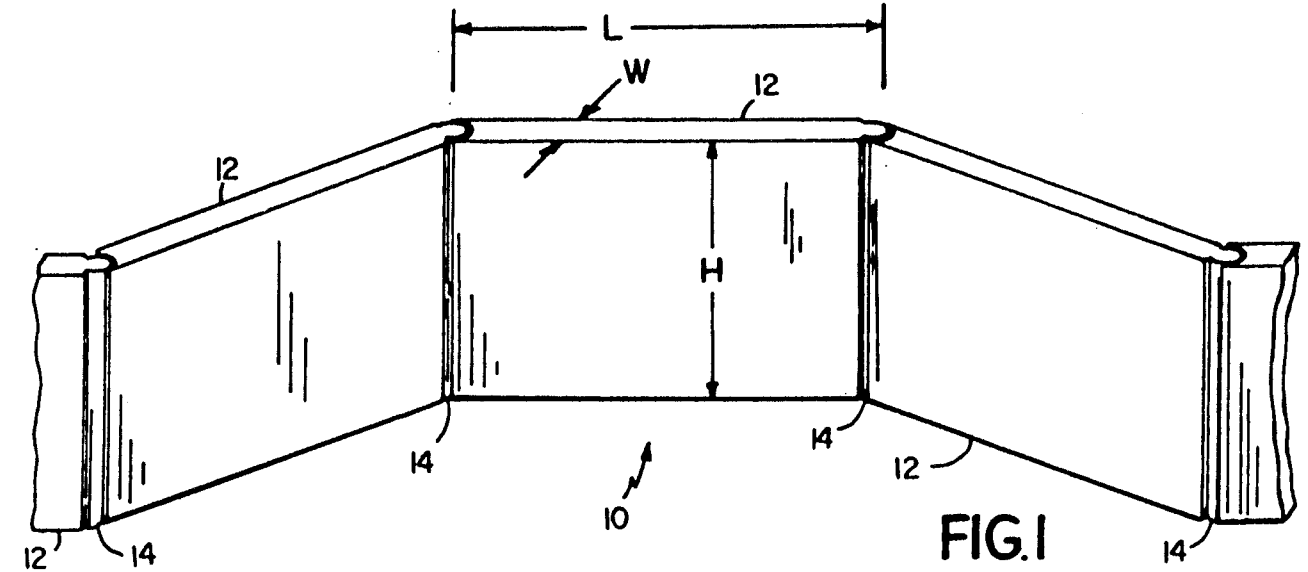
FIGS. 1 and 2 are perspective and plan views, respective, of a barrier wall structure.
Figure 2:
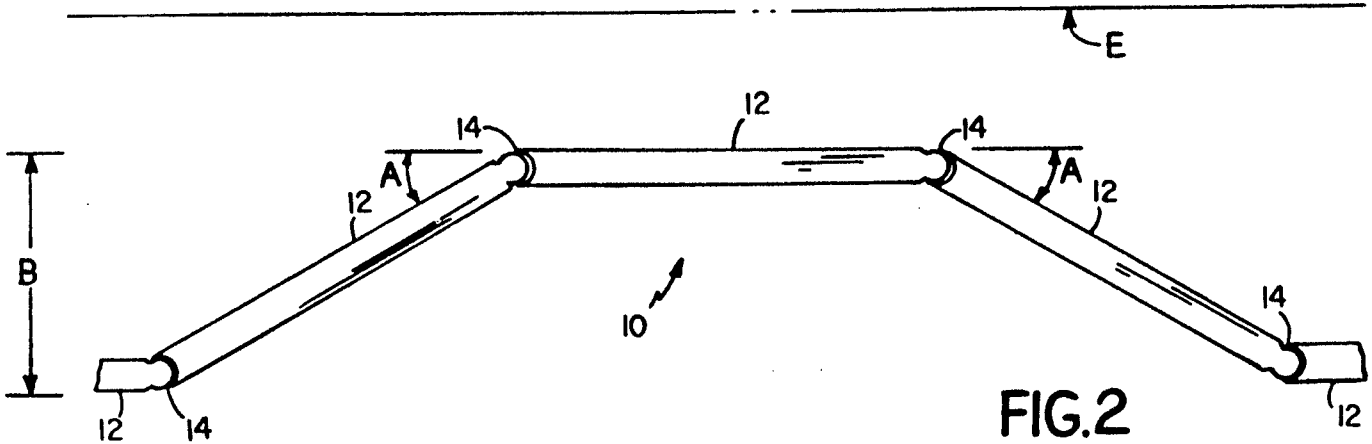

Referring to FIGS. 1 and 2, a barrier wall structure 10 (such as that described in the parent application) includes a series of precast, reinforced concrete modular panels 12 intersecting at joints 14. Each panel 12 has height (H), length (L), and width (W) dimensions selected to meet various specifications and design requirements. For example, in the embodiment shown each panel 12 is between four and twelve feet high, twenty feet long, and 6.5 to twelve inches wide.

Barrier wall structure 10 is free standing and is disposed generally along a line of extension E. Stability is provided by arranging some panels 12 at angles A (such as 30 degrees) with respect to other panels 12 and line E at rotatable joints 14. That is, barrier wall structure 10 undulates along line of extension E and, as a result, a relatively wide right of way B is needed.

Figure 3:
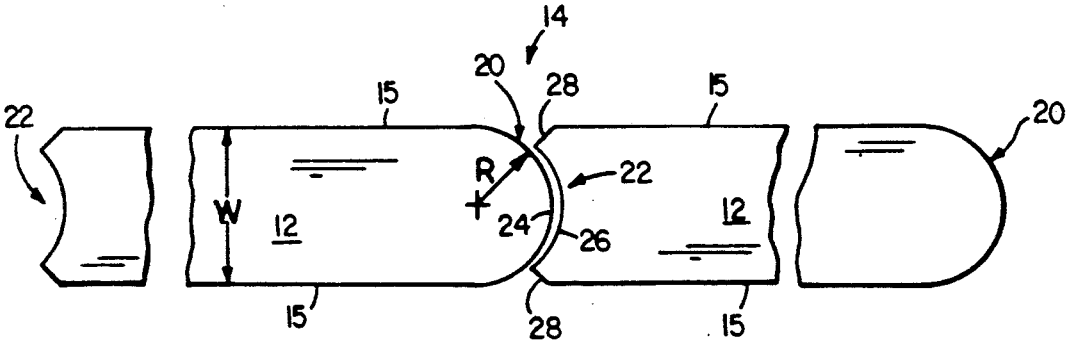
FIGS. 3 and 4 are plan views of two rotatable joints for joining adjacent panels of the barrier wall structure of FIGS. 1 and 2.

Referring also to FIG. 3, one way of providing rotatable joint 14 (discussed in the parent application) is by fabricating one end of each panel 12 as an arcuate (i.e., convex) tongue 20, and forming a complementary-shaped, concave groove 22 at the opposite end of the panel. Each joint 14 is made by joining the tongue 20 of one panel 12 with the groove 22 of an adjacent panel 12. The convex surface 24 of tongue 20 has a radius of curvature R that equals one-half of the width W of panel 12 and extends along an arc of about 180 degrees. The radius of curvature of concave groove surface 26 equals that of convex surface 24, and concave surface 26 extends along an arc of approximately 90 degrees, with the arc ends returning to the faces 15 of panel 12 via surfaces 28. This joint configuration accommodates relatively large angles (such as 45 degrees) between adjacent panels 12.

Figure 4:
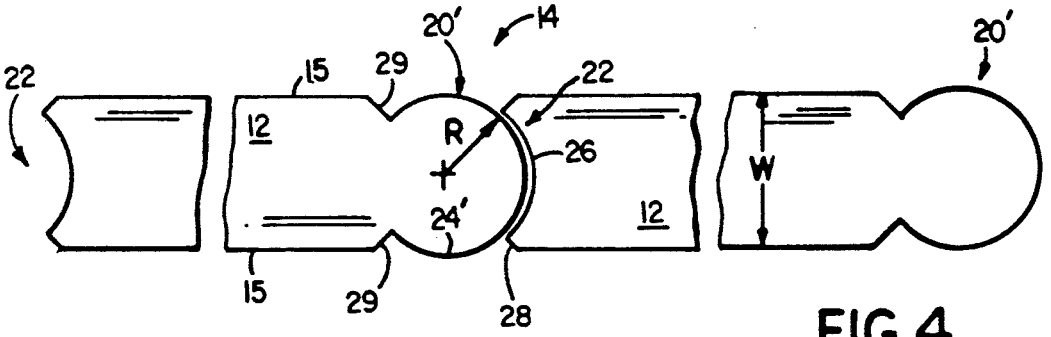

Referring to FIG. 4, angles of up to 90 degrees between adjacent panels may be accommodated with a joint configuration (also discussed in the parent application) that provides each tongue 20' with an arc of 270 degrees. Convex surface 24 returns to the faces 15 of panel 12 via beveled surfaces 29. The radii of curvature R of convex surface 24' and concave surface 22 are equal to each other and are approximately one-half of the width W of panels 12.

The rotatable joints shown in FIGS. 3 and 4 are maintained in engagement by fixing each panel 12 in position with a series of rod and cylinder assemblies that are disposed vertically through corresponding tunnels in panels 12. Details of this arrangement are discussed in the parent application.

Figure 5:
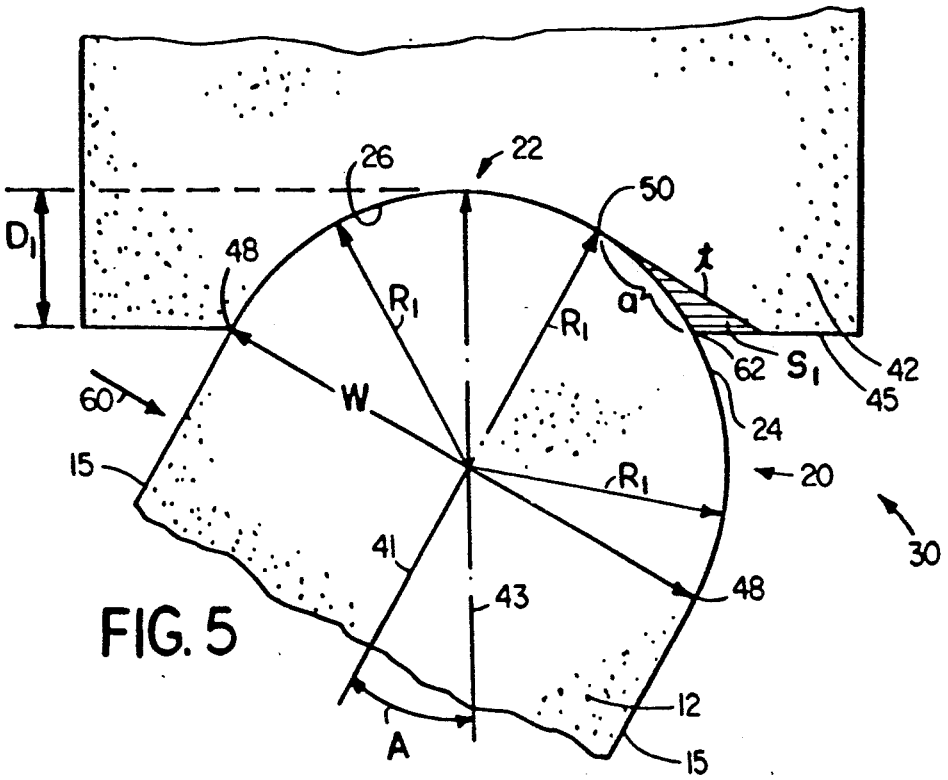
FIG. 5 is useful in understanding the wind shear resistance of a joint similar to that shown in FIG. 3.

FIG. 5 illustrates somewhat diagrammatically the effect of wind on a rotatable joint 30 having a configuration similar to that shown in FIG. 3. Tongue 20 at one end of panel 12 engages groove 22 in a post 42 (post 42 is secured to another panel 12 and provides increased structural stability in the presence of wind). Panel 12 is oriented with an acute angle A between the longitudinal axis 41 of panel 12 and post axis 43 (which is disposed perpendicular to exterior surface 45 of post 42). The convex mating surface 24 of tongue 20 extends from a proximal region 48 of tongue 20 to a distal end 50 thereof. Mating surface 20 is semicircular and extends along an arc of 180°. The radius of curvature $R_1$ of convex surface 24 is one-half of the width, W, of panel 12 between the flat faces 15 thereof. It will be appreciated that the radius of curvature $R_1$ of tongue 20 equals the distance between proximal region 48 and distal end 50.

The concave mating surface 26 of groove 22 has the same radius of curvature $R_1$ as that of convex mating surface 24. Groove 22 is shallow to allow panel 12 to be oriented at large angles with respect to axis 43 (such as 30°). That is, concave surface 26 extends a distance $D_1$ into post 42 that is somewhat less than radius $R_1$ and defines an arc that is less than 180°.

With panel 12 oriented at an angle A of 30°, shaded region $S_1$ represents the area of post 42 that is available to resist shear when the barrier structure is exposed to wind in the direction of arrow 60 (i.e., perpendicular to panel faces 15). Shear area $S_1$ is the region bounded by the arc a between distal end 50 and the edge 62 of concave mating surface 26, the tangent t to convex mating surface 24 at distal end 50, and the exterior surface 45 of post 42. It will be appreciated that shear area $S_1$ decreases as angle A increases. In fact, shear area $S_1$ approaches zero with an angle A at 45°.

Figure 6:
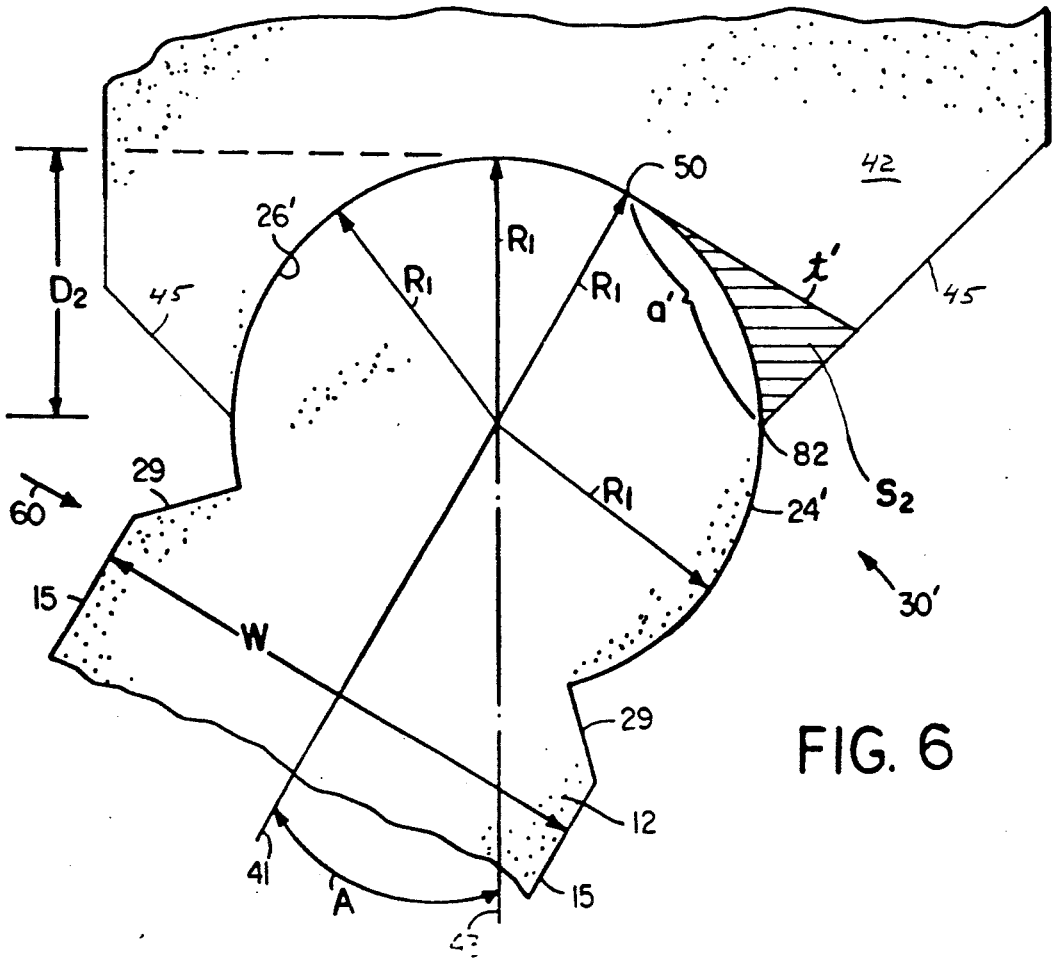
FIG. 6 is useful in understanding the wind shear resistance of a joint similar to that shown in FIG. 4.

Referring to FIG. 6, the shear area is increased by increasing the depth $D_2$ by which the concave mating surface 26 extends into post 42. Depth $D_2$ equals the radius of curvature $R_1$ of concave mating surface 26' (and thus concave surface 26' extends over an arc of 180°). The convex mating surface 24' of panel 12 has the same radius of curvature $R_1$ and extends over an arc of 270°. The ends of surface 24' return via 45° beveled surfaces 29 to the faces 15 of panel 12 (see FIG. 4). Radius $R_1$ is one half of the width, W, of panel 12.

With panel 12 oriented with an angle A (30°) between its longitudinal axis 41 and post axis 43, the shear area between panel 12 and post 42 when panel 12 is exposed to wind 60 is shown by shaded region $S_2$. Shear area $S_2$ is bounded by the arc a' between the distal end 50 of convex surface 24' and the edge 82 of concave mating surface 26', tangent t' to distal end 150, and the exterior beveled (e.g., at 54 degrees) surface 45 of post 42. Shear area $S_2$ is larger than shear area $S_1$ due to the increased depth $D_2$ of concave mating surface 26' within post 42. As a result, the joint 30' between panel 12 and post 42 is more resistant to applied wind forces, thereby reducing the likelihood that wind will dislodge panel 12 from post 42.

Figure 7:
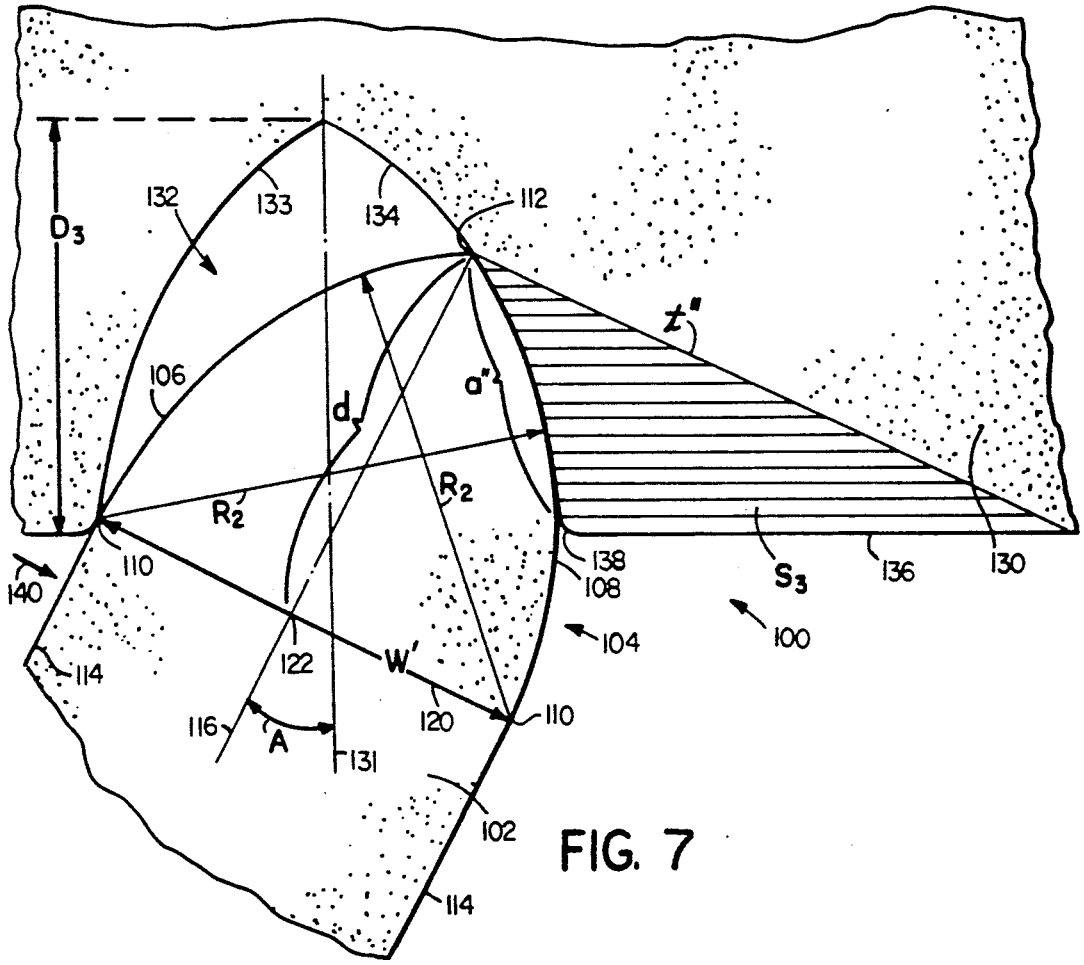
FIG. 7 illustrates a joint profile in which the connector elements have pointed arch configurations to provide increased resistance to wind shear.

Referring to FIG. 7, according to one aspect of this invention the tongues and grooves are shaped to provide a joint profile 100 that is highly resistant to wind shear-induced separation. Panel 102 (which is generally similar in size and shape to panels 12) includes a tongue-shaped engaging element 104 that has a pair of arcuate surfaces 106, 108, each of which extends from a proximal region 110 to a distal end 112 of tongue 104. Proximally of proximal region 110, the faces 114 of panel 102 are parallel to each other. Arcuate surfaces 106, 108 have identical radii of curvature $R_2$ equal to the width W' of panel 102 between parallel faces 114.

The radius of curvature $R_2$ of each arcuate surface 106, 108 originates at proximal region 110 on the face 114 of panel 102 that opposes the arcuate surface. As a result, arcuate surfaces 106, 108 converge and meet at distal end 112 on the longitudinal axis 116 of panel 102. Arcuate surfaces 106, 108 thus combine to form a pointed arch configuration.

The radius of curvature $R_2$ of arcuate surfaces 106, 108 exceeds the length d between proximal region 110 and distal end 112 of tongue 104. Generally, this relationship is true so long as the radii of curvature of surfaces 106, 108 originate at different points along the line 120 that connects surfaces 114 at proximal region 110 (instead of originating at the same point, such as the intersection 122 between axis 116 and line 120 at the center of panel 102).

Post 130 includes a groove-shaped engaging element 32 complementary in shape to tongue 104 for snugly receiving tongue 104 therein. Groove 132 is configured as a pointed arch with arcuate sides 133, 134 having the same radius of curvature $R_2$ as that of surfaces 106, 108. Groove 132 extends a depth $D_3$ into post 130 equal to length d of tongue 104. Thus, when panel 102 is joined in-line with post 130 (i.e., with panel axis 116 aligned with post axis 131), tongue 104 fills groove 132, with proximal region 110 approximately aligned with post exterior surface 136.

Panel 102 is freely pivotable about proximal region 110 within groove 132 to permit panel 102 to be positioned over a wide range of acute angles A with respect to post 130. Groove edges 138 are rounded to ease the pivotal positioning of panel 102. As panel 102 is pivoted (e.g., clockwise in FIG. 7), arcuate surface 108 remains in engagement with arcuate groove surface 134 over a large arc a''. Moreover, the length of tangent t'' to distal end 112 within post 130 is large. Thus, even with panel 102 oriented at a sizeable angle A (30° as shown in FIG. 7), the area $S_3$ within post 130 available to resist shear caused by wind (i.e., in the direction of arrow 140) is substantially increased. Joint 100 is thus highly stable and resistant to separation, even at high wind velocities, thereby reducing the potential for dislodgement of panel 102 due to wind or other forces. Further, the wind shear area is maintained acceptably high even with panel 102 oriented at large acute angles A (such as 45°), thereby providing the designer of the barrier structure with increased flexibility when choosing the placement of panels 102 and posts 130.

Figure 8:
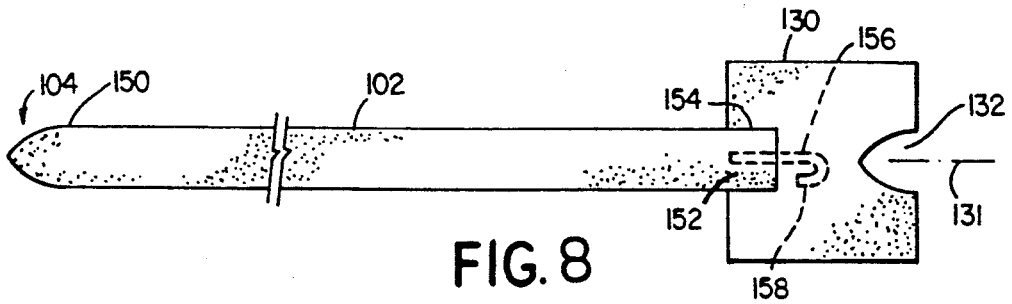
FIGS. 8–10 show panels with various arrangements of pointed arch connector elements.
Figure 9:
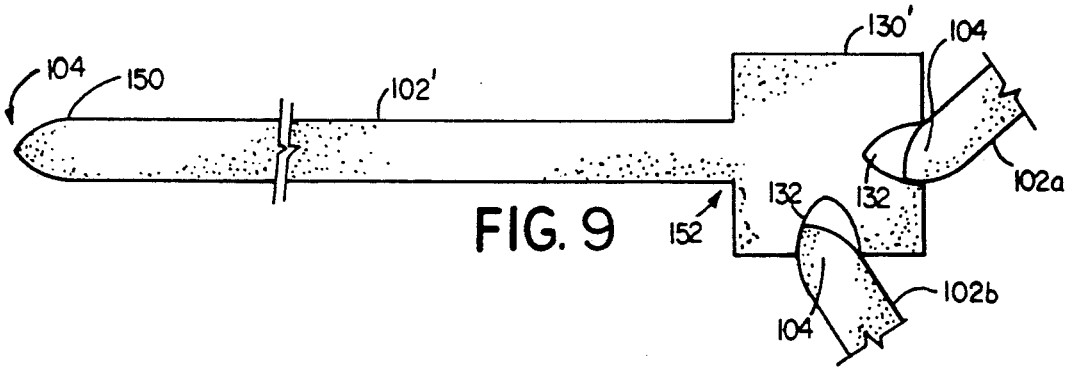
Figure 10:
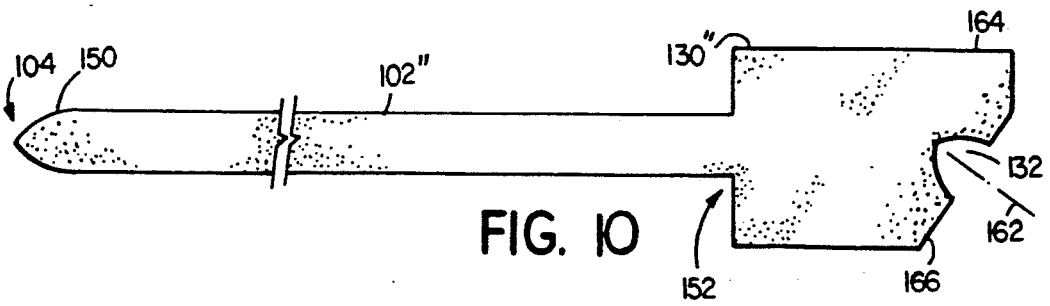
Figure 11:
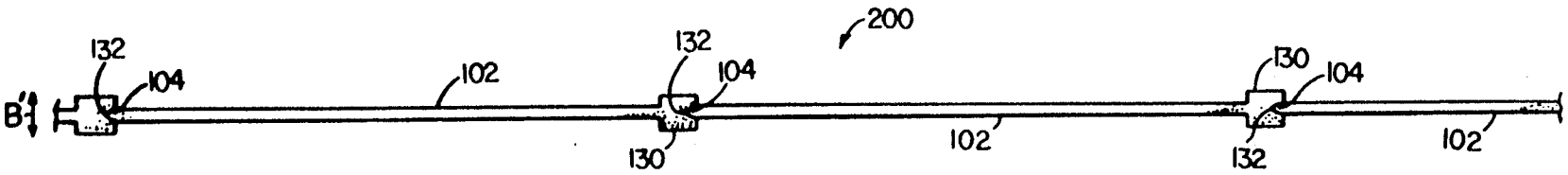
FIGS. 11 and 12 are plan and side views, respectively, of a barrier structure supported by caissons, which are shown in detail in FIGS. 13 and 14.

Referring to FIGS. 8–10, panel 102 and post 130 can have a wide variety of modular constructions. In FIG. 8, one end 150 of panel 102 terminates in pointed arch-shaped tongue 104, and the opposite end 152 is secured within a rectangular cavity 154 of a square post 130, for example, with pins 156. Pins 156 are set in place within post 130 during its fabrication, and one end 158 of pin 156 is hooked for secure retention horizontally. Pointed arch-shaped groove 132 is disposed opposite to cavity 154 to receive the tongue 104 of another panel 102 over a wide range of angles with respect to axis 131.

Referring to FIG. 9, panel 102' includes an integrally formed square post section 130' at end 152. Post section 130' has multiple pointed arch-shaped grooves 132 formed therein. For example, one groove 132 is disposed inline with panel 102' and the other is arranged orthogonally thereto. Panel 102' can thus be used to provide a joint for the connection of panels 102*a* and 102*b*, either or both of which can be pivoted over a range of acute angles to post section 130'.

The integral panel 102' and post section 130' provides numerous advantages. There is no need to align and assemble each panel 102' to its post section 130' during field construction of the barrier wall structure. During field construction, a series of integral panels 102' and post sections 130' are secured together without having to erect the posts and the panels in separate steps. As a result, field construction time and cost are significantly reduced.

Referring to FIG. 10, still other panel-post configurations are possible. Panel 102'' includes post section 130'' with a pointed arch groove 132 oriented along an axis 162 disposed obliquely to the length of panel 102''. Post section 130'' has an irregular geometry to accommodate the obliquely-disposed groove 132. Specifically, one side 164 of post section 130'' is enlarged with respect to the opposite side to provide an exterior surface 166 that is orthogonal to axis 162. This ensures that sufficient post volume envelopes groove 132 to provide the above-discussed wind shear support.

Referring to FIGS. 11–14, barrier wall structure 200 comprising panels 102 and posts 130 (or integral panels 102', 102'' and post sections 130', 130'') is securely held in a fixed horizontal position relative to the plane of the ground 202 and overturning is avoided by anchoring each post 130 of the lower layer 204 of barrier structure 200 to a caisson 206 entrenched in the ground. Although barrier wall structure 200 is not free standing, wall structure 200 can extend substantially along line of extension E (FIG. 1), and thus requires a minimal right of way B'. Stated another way, barrier wall structure 200 derives its stability against overturning from caissons 206, and there is thus no need to support wall 200 by arranging some panels 102 at acute angles to other panels 102 and to the line of extension. (Note that the rotatable joint connection between tongues 104 and grooves 132 allows wall 200 to be configured to extend along, e.g., curved lines of extension without requiring an increased right of way.)

Each caisson 206 is a cylindrical structure, e.g., three feet in diameter, of reinforced concrete 208 that extends a pre-engineered depth (such as 17 feet) into a predrilled hole in the ground to serve as a foundation for panel 102. Reinforcement is provided by eight steel bars 210 that are equally spaced around the perimeter of caisson 206 and extend nearly the entire depth of caisson 206. Additionally, a steel bar 212 may be spirally wound throughout caisson 206.

Figure 12:
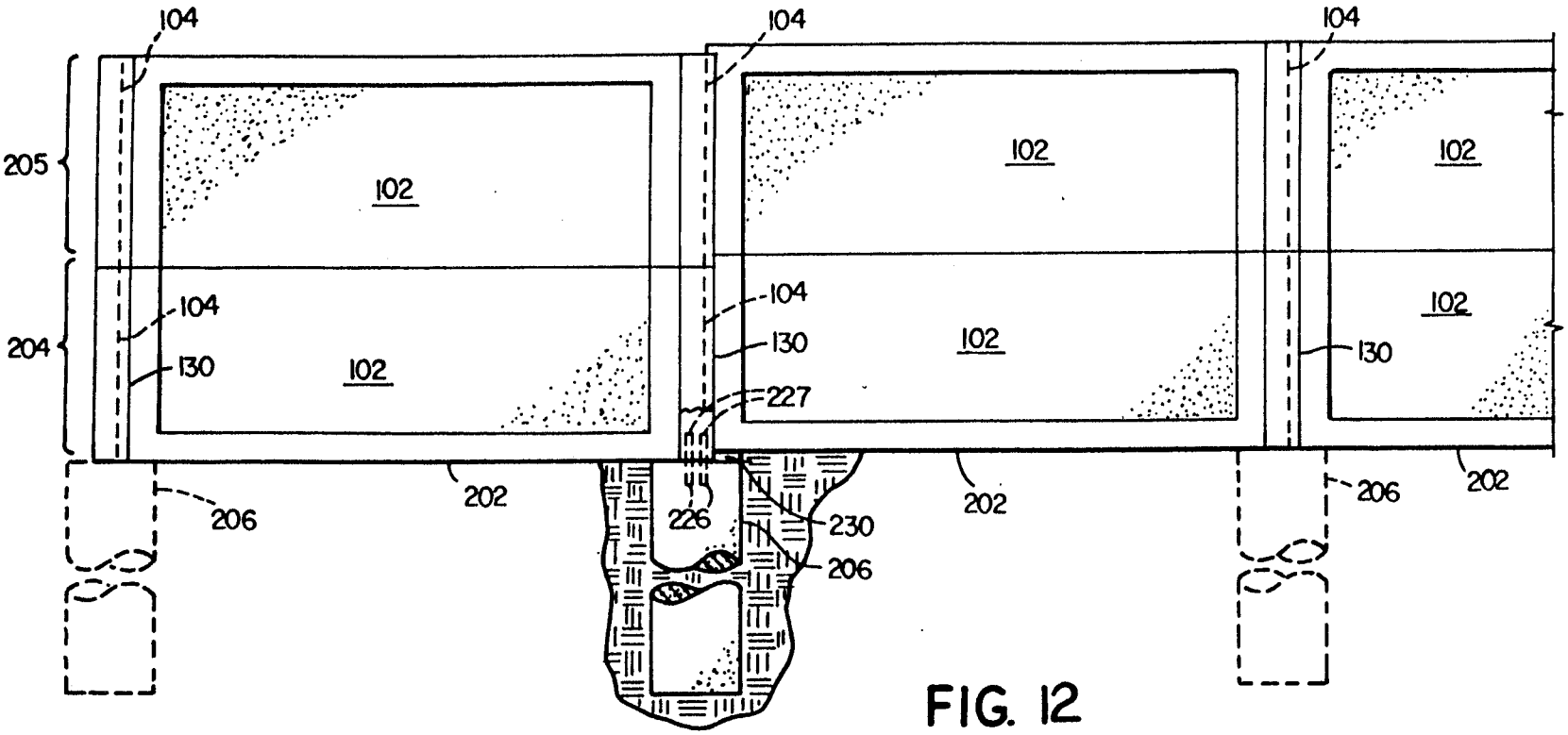

A shallow, square cavity 220 (shown only in FIG. 14) is formed in the upper surface of caisson 206 and during field construction is filled with a high-strength, non-shrink grout. Extending from the bottom of cavity 220, e.g., approximately 3 feet into caisson 206, are four tubes 222, each of which is lined with a horizontally corrugated metal sleeve 224. Sleeves 224 receive metal bars 226 (two of which are shown in FIG. 12) and grout for securely anchoring post 130 to caisson 206. The diameter of each sleeve 224 is larger than that of each bar 226 to provide assembly tolerance.

The posts 130 (or post sections 130', 130'') of each panel in lower level 204 include openings 227 into which bars 226 are inserted (such as over a length of three feet) before post 130 is set in place during field construction. (Threaded couplings near the entrances to openings 227 assist in securing bars 226 within the openings.) After each panel 102 is set in place with its post 130 on caisson 206 (and bars 226 protruding into sleeves 224), a high-strength, non-shrink grout is poured into cavity 220 via the opening provided by groove 132. The grout fills cavity 220 and flows into sleeves 224, occupying the spaces between sleeves 224 and bars 226. When the grout hardens, it securely bonds post 130 to caisson 206 to help prevent separation of the tongue 104 from cavity 132. Moreover, the horizontal corrugations of sleeves 224 impede post 13 from being pulled out of caisson 206 after the grout has hardened.

Any spacing 230 between the upper surface of caisson 06 and the underside of panel 102 should be kept small and shims inserted to level panel 102. High strength, nonshrink grout should then be poured around the shims to help prevent the shims from loosening over time.

The combination of the pointed arch joint configuration 100 (FIG. 7) and the above-described system for erecting posts 130 via caissons 206 provides a highly stable barrier structure which resists joint separation and panel overturn without the need for complex connectors between panels 102 and posts 130. The need to secure posts 30 to caissons 206 with welds or bolts is also eliminated.

A multi-tier barrier wall structure 200 is provided by stacking one or more additional levels 205 of panels 102 and posts 130 on lower level 204. Levels 204, 205 are joined using any of the arrangements discussed in the parent application. Alternatively, the height of panels 102 can be sufficient (e.g., ten feet) so that multiple tiers are unnecessary in a given application.

Figure 14:
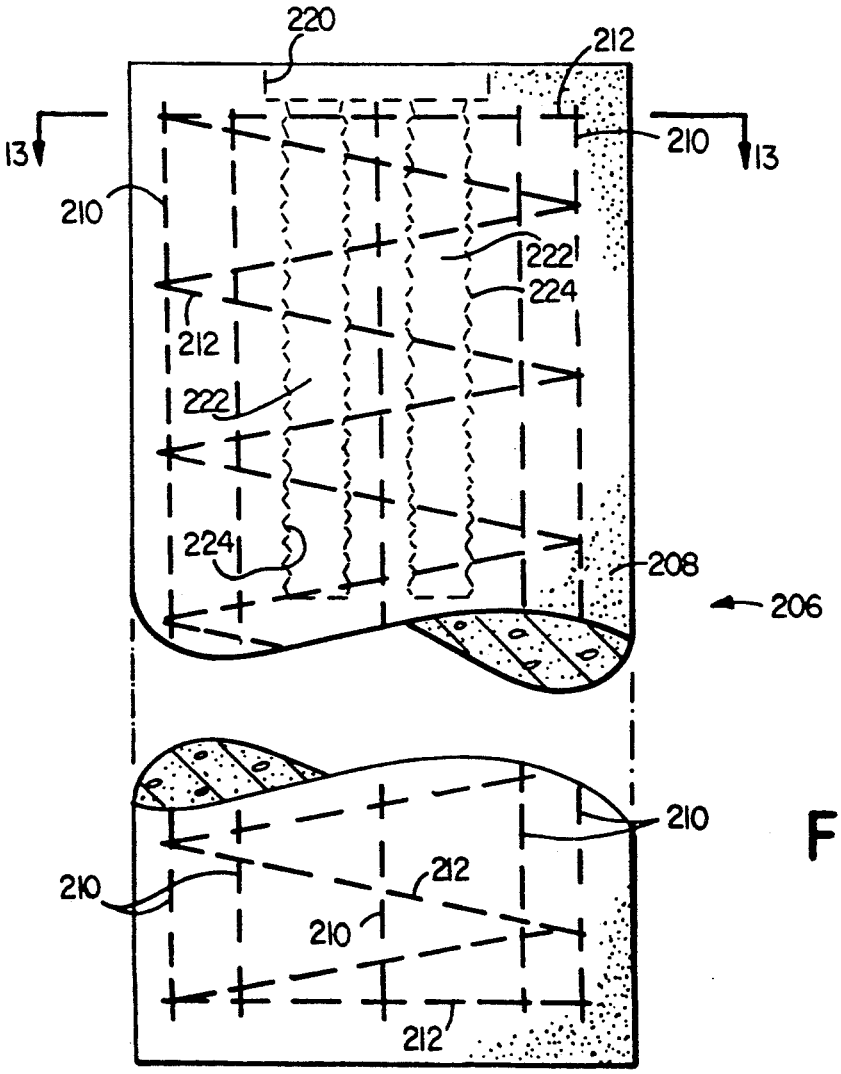
Figure 15:
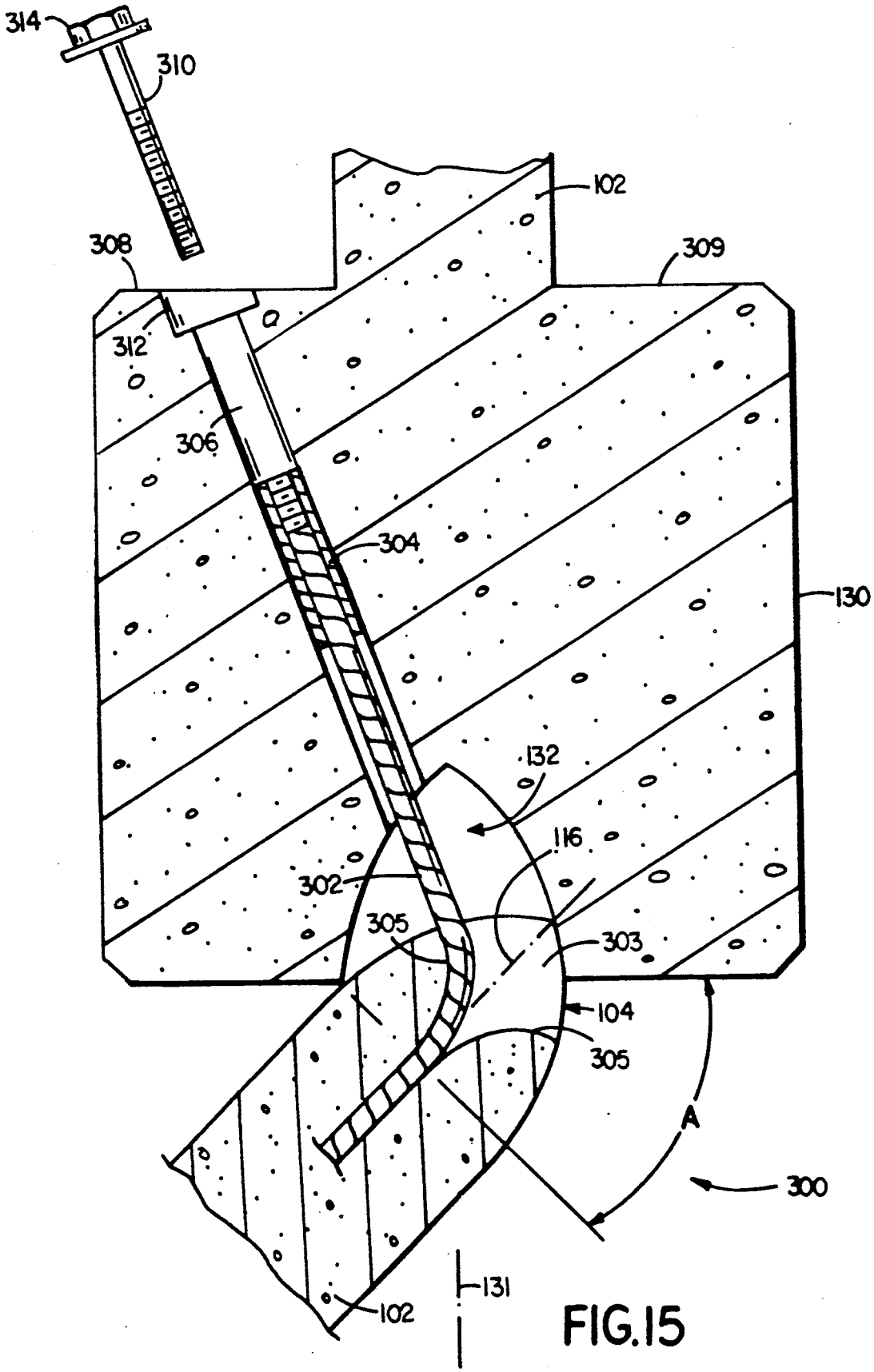
FIG. 15 illustrates another aspect of the invention, in which a cable is used to join adjacent panels of a barrier wall structure.
Figure 16:
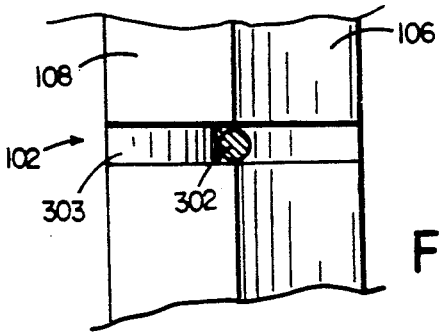
FIG. 16 is an end view of a portion of one of the panels of FIG. 15.

Referring to FIGS. 15 and 16, the invention also provides a tensile connector assembly 300 for joining the tongue 104 of one panel 102 (or panels 102', 102'') within the groove 132 of the post 130 (or post sections 130', 130'') of an adjacent panel. Connector assembly 300 allows the construction of a free-standing, undulating barrier wall structure where the right of way is sufficiently wide, thereby eliminating the need for caissons (FIGS. 12–14) or other ground-embedded structures for stabilizing the barrier wall structure.

One or more stainless steel wire cables 302 (only one being shown in the figures) is centrally cast within panel 102 during fabrication and extends from the distal end of tongue 104 through a cavity 303 formed in tongue 104 during casting. A threaded connector 304 is swaged onto the free end of cable 302. A bore 306 in post 130 extends from groove 132 to an opposite face 308 of post 130 for receiving cable 302 and connector 304. Cable 302 is secured to post 130 with a bolt 310 which is threaded into connector 304. An enlarged region 312 of bore 306 near face 308 provides a recess for receiving the head 314 of bolt 310 to keep bolt 310 hidden from view except by close inspection. Grout may be packed into opening 312 after the bolt is tightened to further hide bolt 310 from view. The unobtrusiveness of connector assembly 300 is advantageous for aesthetic reasons as well as to discourage potential unauthorized tampering.

The length of cable 302 is a function of the depth at which the cable is set into panel 102 (e.g., two feet) and the thickness of post 130. Cable 302 has a diameter (e.g., ⅜ inch) suitable to withstand the tensile forces required to securely fasten panel 102 to post 130 and can be bent around a radius of curvature of approximately five inches. The walls 305 of cavity 303 are curved to provide a smooth bearing surface for cable 302 when panel 102 is oriented at acute angles with respect to post axis 131.

Connector 304 can be of any suitable length (such as 3½ inches) and has an outside diameter of, e.g., ⅜ inch. The threaded portion of connector 304 (and that of bolt 310) is sufficiently long (such as 1½ inches) to allow the overall length of the cable-bolt assembly to be adjusted to accommodate the full rang of angles A between panel 102 and post 130 (e.g., from 0 degrees to 45 degrees) and to permit the tensile force applied by connector assembly 300 to be adjusted To further reduce the visibility of connector assembly 300, cavity 303 may be disposed on only one side of panel axis 116 (such as the left side in FIG. 15). That is, during the casting of panel 102, the remainder of cavity 303 (i.e., the region to the right of axis 116 in FIG. 15) would be filled with concrete. As a result, cable 302 would not be visible by inspecting the joint between panel 102 and post 130. However, such a panel 102 would be suitable for angular orientation in only one direction with respect to post axis 131 (i.e., to the left in FIG. 15). Panels 102 with cavities 303 disposed to the right of axis 116 would be suited for right-hand angles. Similarly, posts 130 can be fabricated with bore 306 between cavity 132 and face 309 (or with a pair of bores 306 between cavity 132 and respective faces 308 and 309).

Figure 17:
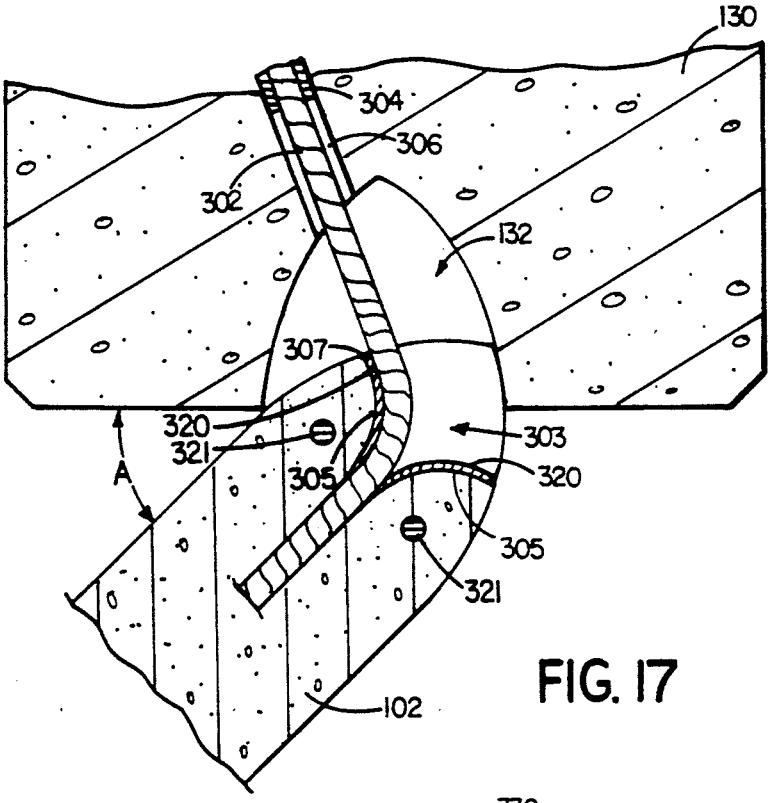
FIG. 17 shows an alternative embodiment of the connection arrangement of FIG. 15.

Referring also to FIG. 17, panel 102 may be equipped with a metal or plastic guard 320 to distribute any concentrated pressure on cable 302 and concrete panel 102, particularly near tips 307, when panel is oriented at relatively large acute angles A with respect to post 130 (such as 30 degrees or more) by distributing the forces imposed on cable 302 and the concrete. Guard 320 is shown in cross-section in FIG. 17 and is funnel-shaped in the plane of the figure and conforms to the walls 305 of cavity 303 to allow cable 302 to extend to the right (as shown) or left as it protrudes from tongue 104. Guard 320 thus serves to reduce the wear on and failure rate of cable 302 and concrete panel 102. Guard 320 is inserted during the casting of panel 102. Alternatively, a sleeve may be placed around the portion of cable 302 within cavity 303. The concrete near cavity walls 305 may be reinforced by disposing metal rods (e.g., rebar) 321 vertically through panel 102.

Figure 19:
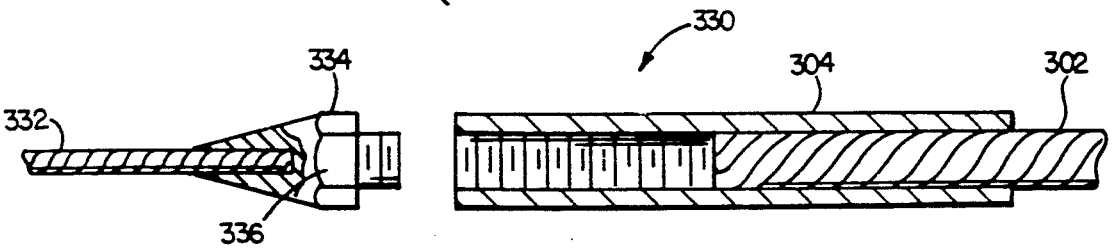
FIGS. 18 and 19 are useful in understanding the procedure for joining panels using the connection arrangement of FIG. 15.
Figure 18:
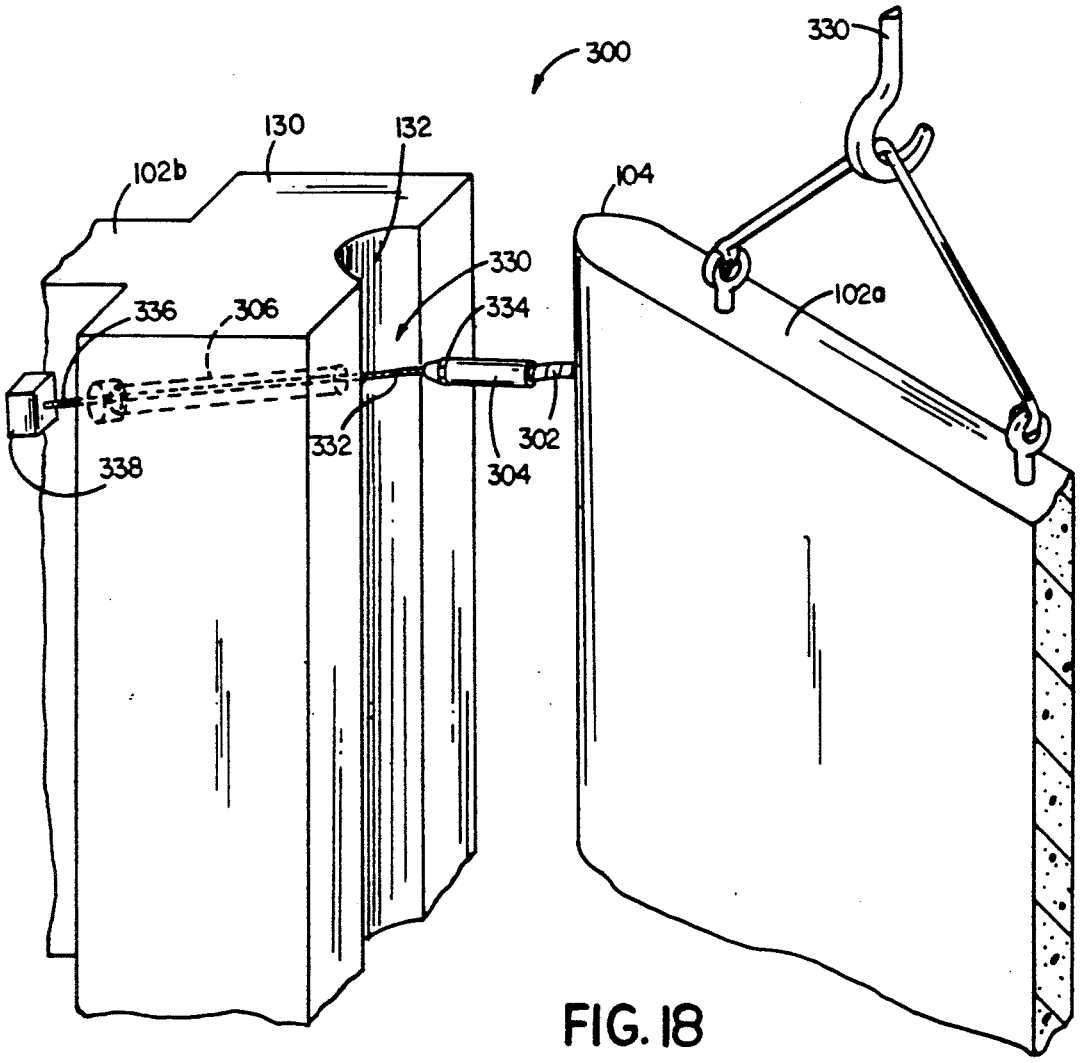

Referring to FIGS. 18 and 19, during construction of the barrier wall structure, as a panel 102*a* is maneuvered into position (such as with a crane 330) for connection with a previously erected panel 102*b*, connector 304 and cable 302 are safely fed through bore 304 using a guide 330. Guide 330 includes a thin, flexible steel wire 332 that has a threaded connector 334 secured at one end thereof. Prior to joining panel 102*a* to post 130, connector 334 is threaded onto connector 304 of cable 302 and the opposite end 336 of wire 332 is hand-fed through bore 306 in post 130. As panel 102*a* is moved into position, wire 332 is fed through bore 306, eventually pulling connector 304 and cable 302 fully into bore 306. A worker positioned on the far side of post 130, at a safe distance from the crane-suspended panel 102*a*, takes up the slack as additional wire emerges from post 130. When tongue 104 is fully engaged within cavity 132 and panel 102*a* is positioned at the desired angle with respect to panel 102*b*, wire connector 334 is removed from cable connector 304. Connector 334 has a hexagonally-shaped portion 336 which receives a tool to assist in removal.

Optionally, a weight 338 may be temporarily fastened to the free end 336 of wire 332, after wire 332 has been fed through bore 306, to take up the slack in wire 332 as it emerges from bore 306. Manual participation in the joining operation thereby is minimized.

One important advantage of the present invention is that the panel and post assemblies (for example, a panel with an integral post as shown in FIG. 9) are generic in their outward appearance, regardless of whether a caisson is used to provide structural support (by anchoring the panel/post assembly to the ground as shown in FIG. 12), or whether the panel/post assembly is free standing (with structural support being provided by securing the panel/post assembly to another panel/post assembly with cable connector 300 as shown in FIGS. 15–19). The result is significantly lowered cost and increased structural and aesthetic flexibility for the designer in selecting each panel/post assembly in accordance with the terrain and with the position of the panel/post assembly in the barrier wall structure.

Figure 13:
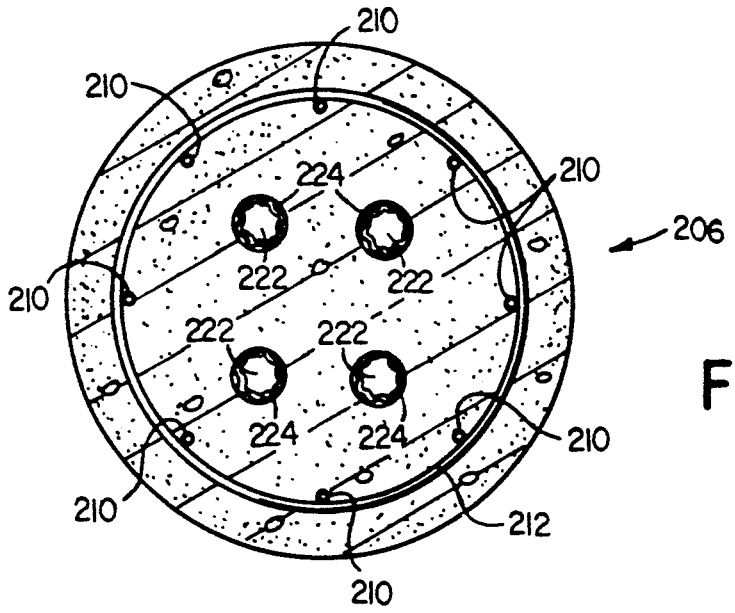

For example, in areas with narrow right of ways, the panel/post assemblies can be arranged in a straight (or curved) line along the line of extension of the barrier wall structure, with the individual posts anchored to the ground using caissons 206 (FIGS. 12–14). Where the terrain requires, or in areas in which a wide right of way exists, the caissons may be omitted and the barrier wall structure made free standing by arranging some panel/-post assemblies at acute angles with respect to other panel/post assemblies (to provide an undulating wall) and tying adjacent panel/post assemblies together using connector assemblies 300 to provide structural support. The pointed arch-shaped tongue and grooves allows adjacent panel/post assemblies to be oriented at large angles (e.g., up to 45 degrees) with significantly reduced risk of dislodgement due to wind forces. Where the right of way again becomes narrow, the barrier structure can be converted from the undulating wall to a straight (or curved) wall by resuming the use of caissons to anchor the posts.

Still other embodiments are within the scope of the following claims. For example, tongue 104 and groove 132 (FIG. 7) may each have a truncated (i.e., flat) distal end and need not terminate at a point.

I claim:

1. A barrier structure constructed to be supported above ground level, comprising at least one panel disposed to extend generally along a fence line, said panel including an engaging element for engaging and pivotally joining said panel to a member of said structure, said engaging element having an arcuate surface that extends from a proximal region of said engaging element to a distal end thereof, said arcuate surface being shaped to permit said panel to be joined to said member over a range of angles with at least a portion of said arcuate surface remaining in engagement with said member, said arcuate surface having a predetermined radius of curvature that exceeds a length of said engaging element between said proximal region and said distal end.

2. The structure of claim 1 wherein said engaging element includes a pair of opposite said arcuate surfaces.

3. The structure of claim 2 wherein said arcuate surfaces are arranged to form an arch configuration.

4. The structure of claim 2 wherein said panel includes a pair of opposite, generally flat surfaces with a predetermined width therebetween, said radius of curvature of each arcuate surface being at least greater than half of said width.

5. The structure of claim 2 wherein said panel includes a pair of opposite, generally flat surfaces with a predetermined width therebetween, said radius of curvature of each arcuate surface being equal to said width.

6. The structure of claim 1 wherein said member includes a second engaging element configured to receive said engaging element of said panel.

7. The structure of claim 6 wherein said second engaging element comprises a groove having a shape that is complementary to said engaging element.

8. The structure of claim 6 wherein said member comprises a portion of a second said panel.

9. The structure of claim 8 wherein each said panel has a first end at which said engaging element is disposed, and a second end at which said second engaging element is disposed, whereby a plurality of said panels are connected to extend generally along said fence line by engagement of said engaging element of one said panel with said second engaging element of another said panel.

10. The structure of claim 6 wherein said member is a post.

11. The structure of claim 10 wherein said post includes a plurality of said second engaging elements for engagement with said engaging elements of a corresponding plurality of said panels.

12. The structure of claim 11 wherein said a pair of said second engaging elements of said post are disposed along a common axis.

13. The structure of claim 11 wherein said a pair of said second engaging elements of said post are disposed orthogonally to each other.

14. The structure of claim 1 further comprising a mounting element adapted to be disposed in the ground and be secured to a portion of said panel to provide support for said panel.

15. The structure of claim 14 wherein said portion of said panel is an end of said panel disposed oppositely to said engaging element.

16. The structure of claim 15 wherein said portion of said panel includes a second engaging element configured to receive said engaging element of another said panel.

17. The structure of claim 14 wherein said mounting element and said portion of said panel each include at least one opening therein that are arranged to be aligned when said panel is disposed on said mounting element, and further comprising means disposed in said openings for anchoring said panel to said mounting element.

18. The structure of claim 17 wherein said means for anchoring comprises a rod positioned within said openings and grout for securing said rod in place within at least one of said openings.

19. The structure of claim 18 wherein said rod is threadably received in the opening of said panel.

20. The structure of claim 14 wherein said mounting element comprises reinforced concrete.

21. The structure of claim 1 further comprising a connector assembly for securing said panel to said member.

22. The structure of claim 21 wherein said connector assembly comprises a cable extending from engaging element and adapted to be disposed through an opening in said member, and a connector for anchoring said cable to said member.

23. The structure of claim 22 wherein said member comprises a post that includes a second engaging element having a groove with a shape that is complementary to said engaging element of said panel, said opening being disposed between said groove and an opposite side of said post.

24. The structure of claim 22 wherein said engaging element includes a cavity near the distal end thereof through which said cable protrudes to facilitate positioning said panel over a range of angles with respect to said post.

25. A barrier structure, comprising at least one panel disposed to extend generally along a fence line, said panel including an engaging element for pivotal joining of said panel to a member of said structure, said engaging element of said panel having an arcuate surface that extends from a proximal region of said engaging element to a distal end thereof, said arcuate surface having a predetermined radius of curvature that exceeds a length of said engaging element between said proximal region and said distal end, said member comprising a post that includes a plurality of second engaging elements each of which is configured to receive a said engaging element of a corresponding plurality of said panels, said pair of said second engaging elements of said post are disposed obliquely to each other.

26. A barrier structure, comprising at least one panel disposed to extend generally along a fence line, said panel including an engaging element for pivotal joining of said panel to a member of said structure, said engaging element having an arcuate surface that extends from a proximal region of said engaging element to a distal end thereof, said arcuate surface having a predetermined radius of curvature that exceeds a length of said engaging element between said proximal region and said distal end, and a mounting element adapted to be disposed in the ground and be secured to an end portion of said panel and provide support for said panel, said end portion being disposed oppositely to said engaging element, said end portion being configured as a post and including a second engaging element configured to receive said engaging element of another said panel.

27. A barrier structure, comprising at least one panel disposed to extend generally along a fence line, said panel including an engaging element for pivotal joining of said panel to a member of said structure, said engaging element having an arcuate surface that extends from a proximal region of said engaging element to a distal end thereof, said arcuate surface having a predetermined radius of curvature that exceeds a length of said engaging element between said proximal region and said distal end, a mounting element adapted to be disposed in the ground and be secured to a portion of said panel and provide support for said panel, said mounting element and said portion of said panel each including at least one opening therein that are arranged to be aligned when said panel is disposed on said mounting element, means disposed in said openings for anchoring said panel to said mounting element, said anchoring means comprising a rod positioned within said openings and grout for securing said rod in place within at least one of said openings, said opening in said mounting element having corrugated walls, whereby when said grout has hardened, said rod is prevented from sliding out of said opening.

* * * * *

UNITED STATES PATENT AND TRADEMARK OFFICE

CERTIFICATE OF CORRECTION

PATENT NO. : 5,134,815

DATED : August 4, 1992

INVENTOR(S) : William H. Pickett

It is certified that error appears in the above-identified patent and that said Letters Patent is hereby corrected as shown below:

Col. 1, line 33 replace "ar" with --are--.

Col. 7, line 43 replace "13" with --130--.

Col. 7, line 57 replace "30" with --130--.

Col. 8, line 37 replace "3 1/2" with --3 3/4--.

Col. 8, line 39 replace "1 1/2" with --1 3/4--.

Col. 8, line 41 replace "rang" with --range--.

Signed and Sealed this

Twelfth Day of October, 1993

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,134,815

DATED : August 4, 1992

INVENTOR(S) : William H. Pickett

It is certified that error appears in the above-identified patent and that said Letters Patent is hereby corrected as shown below:

On the title page, item [22]: the Application filing date of "Jan. 8, 1981" should be --Jan. 8, 1991--.

Signed and Sealed this

Sixteenth Day of July, 1996

*Attest:*

*Attesting Officer*

BRUCE LEHMAN

*Commissioner of Patents and Trademarks*